US009190739B2

(12) United States Patent
Shi

(10) Patent No.: US 9,190,739 B2
(45) Date of Patent: Nov. 17, 2015

(54) ANTENNA WITH FIFTY PERCENT OVERLAPPED SUBARRAYS

(71) Applicant: DELPHI TECHNOLOGIES, INC., Troy, MI (US)

(72) Inventor: Shawn Shi, Thousand Oaks, CA (US)

(73) Assignee: Delphi Technologies, Inc., Troy, MI (US)

( * ) Notice: Subject to any disclaimer, the term of this patent is extended or adjusted under 35 U.S.C. 154(b) by 345 days.

(21) Appl. No.: 13/925,227

(22) Filed: Jun. 24, 2013

(65) Prior Publication Data

US 2014/0375525 A1 Dec. 25, 2014

(51) Int. Cl.

| | |
|---|---|
| ***H01Q 21/00*** | (2006.01) |
| ***H01Q 13/20*** | (2006.01) |
| ***H01Q 21/06*** | (2006.01) |
| ***H01Q 21/22*** | (2006.01) |

(52) U.S. Cl.

CPC ..... *H01Q 21/0037* (2013.01); *H01Q 13/206* (2013.01); *H01Q 21/0068* (2013.01); *H01Q 21/068* (2013.01); *H01Q 21/22* (2013.01)

(58) Field of Classification Search

USPC ..... 343/700 MS, 771, 853, 893; 342/372, 342/373

See application file for complete search history.

(56) References Cited

U.S. PATENT DOCUMENTS

| | | | | |
|---|---|---|---|---|
| 3,631,503 | A | 12/1971 | Tang | |
| 3,938,160 | A | 2/1976 | Mailloux et al. | |
| 4,652,880 | A | 3/1987 | Moeller et al. | |
| 4,939,527 | A * | 7/1990 | Lamberty et al. | 343/771 |
| 5,034,752 | A | 7/1991 | Pourailly et al. | |
| 6,104,343 | A * | 8/2000 | Brookner et al. | 342/372 |
| 6,621,468 | B2 * | 9/2003 | Kanamaluru | 343/853 |
| 7,474,262 | B2 | 1/2009 | Alland | |
| 7,576,696 | B2 * | 8/2009 | Walton et al. | 343/700 MS |
| 7,868,828 | B2 | 1/2011 | Shi et al. | |
| 7,889,135 | B2 * | 2/2011 | Blaser et al. | 343/700 MS |
| 8,362,965 | B2 * | 1/2013 | Henderson | 343/778 |
| 8,866,687 | B2 * | 10/2014 | Biancotto et al. | 343/776 |

FOREIGN PATENT DOCUMENTS

| | | |
|---|---|---|
| EP | 2 071 670 A1 | 6/2009 |
| GB | 2 034 525 A | 6/1980 |

OTHER PUBLICATIONS

J.S. Herd, et al.: "Design considerations and results for an overlapped subarray radar antenna", 2005 IEEE Aerospace Conference, Jan. 1, 2005, pp. 1087-1092, XP055155763, DOI: 10.1109/AERO.2005.1559399 ISBN: 978-0-78-038870-3.

European Search Report dated Nov. 28, 2014.

* cited by examiner

*Primary Examiner* — Tho G Phan

(74) *Attorney, Agent, or Firm* — Lawrence D. Hazelton

(57) ABSTRACT

An antenna suitable for use as a phased array antenna of a radar system. The antenna includes a plurality of radiating elements, and a substrate integrated waveguide (SIW) configured to form a feed network to couple energy from a plurality of inputs to the radiating elements. The feed network includes over-moded waveguide couplers configured so energy propagates through an over-moded section in multiple modes, TE10 and TE20 modes for example. The feed network also defines sub-arrays configured such that half of the radiators of a sub-group are shared with an adjacent sub-group of an adjacent sub-array, i.e. the sub-arrays are configured to have 50% overlap. Preferably, the feed-network is formed about a single layer of substrate material.

11 Claims, 3 Drawing Sheets

ANTENNA WITH FIFTY PERCENT OVERLAPPED SUBARRAYS

TECHNICAL FIELD OF INVENTION

This disclosure generally relates to a phased array antenna of a radar system, and more particularly relates to an antenna with multiple sub-arrays of grouped radiating elements coupled to inputs by a substrate integrated waveguide (SIW) type feed network that includes over-moded waveguide couplers that allow half (50%) of the radiating elements of one sub-array to overlap with radiating elements of another sub-array.

BACKGROUND OF INVENTION

Radar systems often require an antenna with many elements to provide the required gain, beam-width, etc. Electronic scanning or digital beam-forming using an array of antenna elements or radiating elements is known, but is often undesirably costly to implement since phase control modules and/or receivers for each radiating element are typically required. For limited scan, a phased array antenna may be formed by grouping the radiating elements into sub-arrays. This reduces the number of phase control modules/receivers required, but undesirably leads to grating lobes. Grating lobes can be mitigated by appropriately increasing the number of radiating elements in each sub-array to narrow the sub-array pattern in a manner that does not increase the spacing between the sub-arrays. This requires the sub-arrays to be overlapped, that is, elements shared between sub-arrays. However, acceptable grating lobe suppression is difficult to achieve for limited scan antennas that use sub-arrays. U.S. Pat. No. 7,868,828 entitled PARTIALLY OVERLAPPED SUB-ARRAY ANTENNA, issued Jan. 11, 2011 to Shi et al. describes an antenna with sub-arrays that overlap one-fourth or twenty five percent (25%) of the radiation elements, the entire contents of which are hereby incorporated herein by reference.

SUMMARY OF THE INVENTION

In accordance with one embodiment, an antenna suitable for use as a phased array antenna of a radar system is provided. The antenna includes a plurality of radiating elements, and a feed network. The feed network is configured to define a plurality of inputs and couple energy from the inputs to the radiating elements. Energy from each of the inputs is first coupled to a power divider defined by the feed network. The feed network also defines a plurality of over-moded waveguide couplers configured to define a plurality of sub-arrays that couple each input to a sub-group of the radiating elements. The sub-arrays are arranged in a side-by-side arrangement and configured such that half of the radiators of a sub-group are shared with an adjacent sub-group of an adjacent sub-array. Each of the over-moded waveguide couplers is configured to define a left in-port that receives energy from a left divider, a right in-port that receives energy from a right divider adjacent the left divider, a left out-port that guides energy to a left radiator, and a right out-port that guides energy to a right radiator adjacent the left radiator. Each over-moded waveguide coupler includes an over-moded section defined by a width selected such that energy propagates through the over-moded section in multiple modes effective to establish a first path for energy from the left in-port and a second path for energy from the right in-port, wherein the first path is distinct from the second path.

In one embodiment, the feed-network is formed about a single layer of substrate material.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1A:
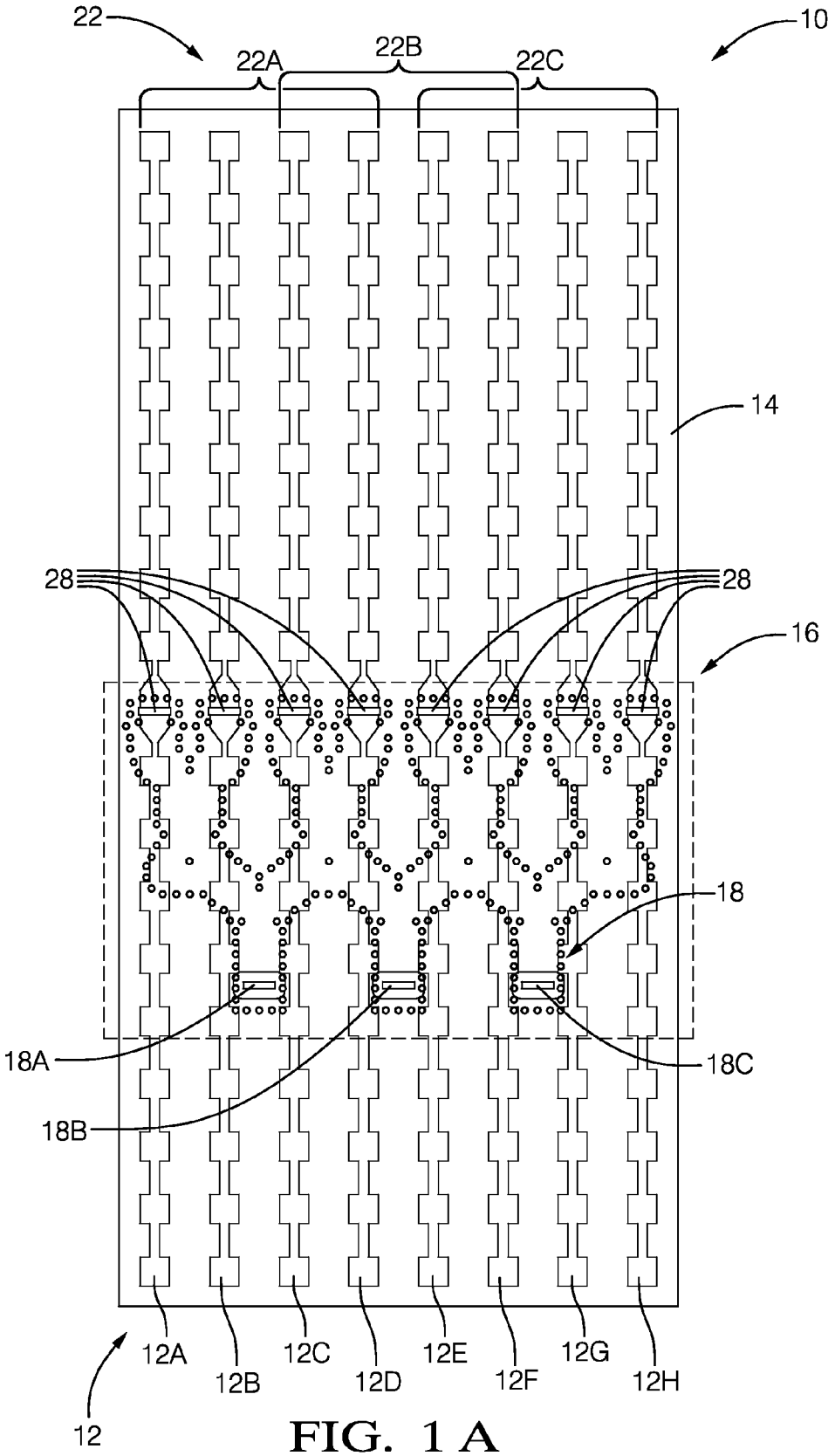
FIG. 1A is a top view of an antenna suitable for use as a phased array antenna of a radar system in accordance with one embodiment.

FIG. 1A illustrates a top view of a non-limiting example of a phased array antenna, hereafter the antenna 10. In general, the antenna 10 and variations thereof described herein are suitable for use by a radar system (not shown), for example as part of an object detection system on a vehicle (not shown). By way of example and not limitation, the antenna 10 described herein may be part of object detection system on a vehicle that combines signals from a camera and a radar to determine the location of an object relative to a vehicle. Such an integrated radar and camera system has been proposed by Delphi Incorporated, with offices located in Troy, Mich., USA and elsewhere that is marketed under the name RACam, and is described in United States Published Application Number 2011/0163916 entitled INTEGRATED RADAR-CAMERA SENSOR, published Jul. 7, 2011 by Alland et al., the entire contents of which are hereby incorporated herein by reference. Sizes or dimensions of features of the antenna 10 described herein are selected for a radar frequency of 76.5*10^9 Hertz (76.5 GHz). However, these examples are non-limiting as those skilled in the art will recognize that the features can be scaled or otherwise altered to adapt the antenna 10 for operation at a different radar frequency.

In general, the antenna 10 includes a plurality of radiating elements 12. The radiating elements 12 may also be known as microstrip antennas or microstrip radiators, and may be arranged on a substrate 14. The antenna 10 in this non-limiting example includes eight radiating elements (12A, 12B, 12C, 12D, 12E, 12F, 12G, 12H). However it should be recognized that this number was only selected to simplify the illustrations, and that antennas with more radiating elements are contemplated, for example twenty-six radiating elements.

Each radiating element may be a string or linear array of radiator patches formed of half-ounce copper foil on a 380 micrometer (μm) thick substrate such as RO5880 substrate from Rogers Corporation of Rogers, Conn. A suitable overall length of the radiating elements 12 is forty-eight millimeters (48 mm). The patches preferably have a width of 1394 μm and a height of 1284 μm. The patch pitch is preferably one guided wavelength of the radar signal, e.g. 2560 μm, and the microstrips interconnecting each of the patches are preferably 503 μm wide. Preferably, the radiating elements 12 are arranged on the surface of the substrate 14, and other features such as a feed network 16 are arranged on lower of the substrate 14.

Figure 1B:
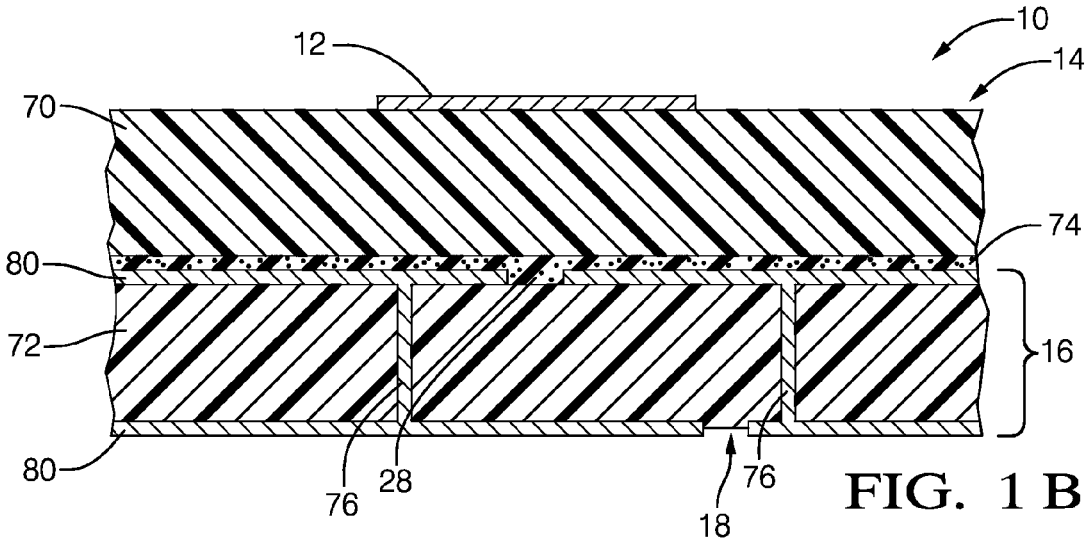
FIG. 1B is a conceptual sectional view of features present in the antenna of FIG. 1A in accordance with one embodiment.

FIG. 1B illustrates a conceptual sectional view of a portion of the antenna 10 illustrated in FIG. 1A. This conceptual view does not directly correspond to a particular cross section of FIG. 1A, but is presented in order to illustrate various individual features in FIG. 1A from a different perspective. In this non-limiting example, the substrate 14 includes an antenna substrate 70 for supporting the radiating element 12, and a waveguide substrate 72 about which the feed network 16 is built. In one embodiment, the antenna substrate 70 may be bonded or attached to the feed network 16 with an adhesive or bonding film 74. Preferably, the feed network 16 is built about a single layer substrate with copper foil on both sides and using vias 76 to form a via-fence 26 (FIG. 2) built into the waveguide substrate 76 to form substrate-integrated-waveguide (SIW) as the feed network 16. Alternatively, instead of attaching the antenna substrate 70 to the feed network 16, the antenna 10 may be a more monolithic type structure that incorporates the features described herein into a single multi-layer substrate.

In this example, the outline of the feed network 16 is defined by an arrangement of a plurality of vias between two metallization layers 80 (e.g. copper foil) on opposing sides of the waveguide substrate 72 to form a via-fence 26 (FIG. 2), as will be recognized by those in the art. Alternatively, the shape of feed network 16 may be determined by an outline of a metallization layer with a dielectric gap between the feed network 16 and any other features on the layer of the substrate 14 occupied by the feed network 16. Preferably, the feed network 16 is formed on a single layer of the substrate 14 to simplify the fabrication of the feed network 16 and thereby reduce the manufacturing costs of the substrate 14. Furthermore, it has been discovered that various performance characteristics of the antenna 10 are more consistent with less manufacturing part-to-part variability when the feed network 16 is formed on a single layer of the substrate 14.

Figure 2:
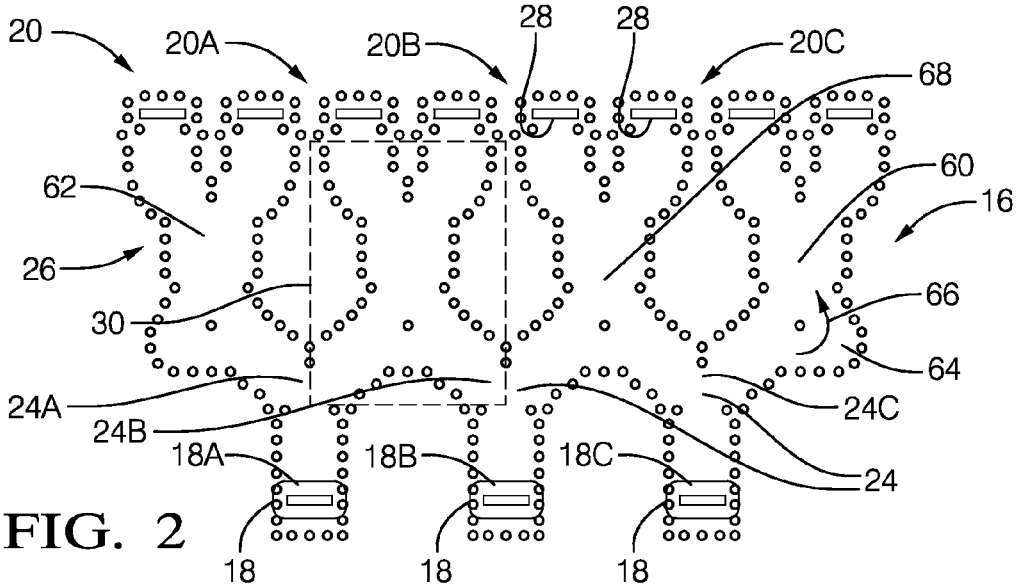
FIG. 2 is a top view of a feed network of the antenna of FIG. 1A in accordance with one embodiment.

FIG. 2 further illustrates a non-limiting example the feed network 16. In general, the feed network 16 is configured to define a plurality of inputs 18 and couple energy from the inputs 18 to the radiating elements 12 via outputs 28. In this example, the feed network 16 is illustrated as having three inputs (18A, 18B, 18C) only for the purpose of simplifying the illustration. As with the radiating elements 12, antennas with additional inputs are contemplated, for example twelve inputs for twelve sub-arrays. In general, the feed network 16 operates to distribute preferentially the energy received at each input 18A, 18B, 18C to a selected sub-group (22A, 22B, 22C) of the radiating elements 12. In this example as will be described in more detail below, each input is associated with four of the radiating elements 12. For example, a first input 18A is associated with sub-group 22A that includes radiating elements 12A, 12B, 12C, 12D; a second input 18B is associated with sub-group 22B that includes radiating elements 12C, 12D, 12E, 12F; and a third input 18C is associated with sub-group 22C that includes radiating elements 12E, 12F, 12G, 12H. This association defines a plurality of sub-arrays 20 (20A, 20B, 20C) that couple each input 18A, 18B, 18C to the sub-groups 22 of the radiating elements 12. As illustrated, the sub-arrays 20 are arranged in a side-by-side configuration such that half of the radiating elements 12 of a sub-group (22A, 22B, 22C) or sub-array (20A, 20B, 20C) are shared with an adjacent sub-group (22A, 22B, 22C) or adjacent sub-array (20A, 20B, 20C).

In order to distribute energy from an input (18A, 18B, 18C), energy from each of the inputs 18 may be coupled to power dividers 24 defined by the via-fence 26, e.g. a left divider 24A, a right divider 24B, and another divider 24C. The power dividers 24 may be the first features of the feed network 16 that begin the distribution of energy from each of the inputs 18 to each of the sub-groups 22.

The via-fence 26 that determines the outline of the feed network 16 may be further configured to define one or more over-moded waveguide couplers, hereafter often the couplers 30. In general, the couplers 30 cooperate with other features of the sub-arrays 20 to distribute energy from each of the input 18 to the sub-groups 22 of the radiating elements 12. The sub-arrays 20 generally are arranged in a side-by-side arrangement and configured such that half of the radiators of one sub-group (e.g.—sub-group 22A) of a sub-array are shared with an adjacent sub-group (e.g.—sub-group 22B) of an adjacent sub-array.

Figure 3:
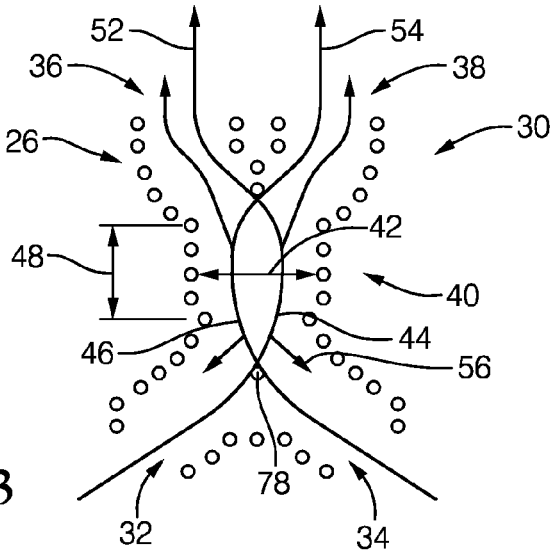
FIG. 3 is a top view of a portion of the feed network of FIG. 2 in accordance with one embodiment.

FIG. 3 is a non-limiting example of the coupler 30 (i.e. the over-moded waveguide coupler). In this example, the shape of the coupler 30 is determined by the via-fence 26. In general, the coupler 30 is configured to define a left in-port 32 that receives energy from the left divider 24A; a right in-port 34 that receives energy from a right divider 24B; a left out-port 36 that guides energy to a left radiator 12C (FIG. 1A); and a right out-port 38 that guides energy to a right radiator 12D.

The coupler 30 also includes an over-moded section 40 defined by a width 42 selected such that energy propagates through the over-moded section 40 in multiple modes. By way of example and not limitation, the multiple modes may include various transverse electric (TE) modes such as a TE10 mode and a TE20 mode. If the waveguide is wide enough, both TE10 and TE20 modes can propagate within the over-moded section 40. As the two modes have different propagation constants, they can combine at a particular distance along the over-moded section 40 where they combine additively at one side of the over-moded section 40, and combine destructively at the other side of the over-moded section 40. For a 76.5 GHz radar signal and a RO5880 substrate, a suitable width 42 for the over-moded section 40 is 2.33 mm.

If the overall shape of the over-moded section 40 is selected so the two modes are combined in the right ratio, the energy propagation can be envisioned to appear as though energy bounces left and right as it propagates through the over-moded section 40. The resulting effect is effective to establish a first path 44 for energy from the left in-port 32 and a second path 46 for energy from the right in-port 34. As illustrated, the first path is distinct from the second path.

The magnitude or amplitude of energy at each of the ports (32, 34, 36, 38) can be tailored by selecting a length 48 and/or the width 42 of the over-moded section 40 such that a first amount 52 (e.g.—magnitude or amplitude) of energy propagates from the left in-port 32 to the left out-port 36; a second amount 54 of energy less than the first amount 52 propagates from the left in-port 32 to the right out-port 38. By controlling or biasing the portion of the energy received from an in-port (32, 34) of the over-moded section 40, the total amount of energy received by radiating elements connected to the out-ports (36, 38) can be tailored to optimize the performance characteristics of the antenna 10. For a 76.5 Hz radar signal, a suitable length 48 for the over-moded section 40 is 1.54 millimeters (mm), and a suitable width 42 is 2.33 mm.

The amplitude and phase distribution of the two outputs (i.e. left out-port 36 and right out-port 38) of the coupler 30 are determined by the length and width of the over-moded section. For example, fixing width, a length can be found for equal phase outputs, but the amplitude taper might be wrong. This process needs to be repeated with different width until the desired amplitude taper and equal phase outputs are achieved.

The vertical location of the single via 78 located below the over-moded section and between the two in-ports can be selected so a third amount 56 of energy less than the second amount 54 propagates from the left in-port 32 to the right in-port 34. This provides a source of energy to other radiating elements that may be further used to optimize the performance characteristics of the antenna 10. By way of example, in one embodiment the antenna 10 may be configured so energy that propagates from the left in-port 32 to an adjacent radiator 12E via the right in-port 34 and is out-of-phase (e.g. 180 degrees of phase difference) with energy from the left in-port 32 that propagates to the left radiator 12C and the right radiator 12D. The out-of-phase energy radiated by the adjacent radiator 12E combines with energy radiated by the left radiator 12C and the right radiator 12D to improve the performance characteristics of the antenna 10. As a result, a flat top is created on the sub-array radiation pattern that provides a more uniform antenna gain when the beam scans around a bore-sight normal to the antenna 10.

Returning now to FIGS. 1 and 2, since in this example the general shape of the over-moded waveguide coupler 30 is symmetrical about the vertical axis of the figures, it follows that the distribution (e.g.—first distribution) of energy from the left in-port 32 is a mirror image of the distribution (e.g.—a second distribution) of energy from the right in-port 34. This symmetry may be particularly advantageous for predicting performance characteristics of antenna configuration with more sub-arrays than the three sub-array configuration of the antenna 10 described herein.

The non-limit example of the antenna 10 describe above is generally configured so each sub-array includes a sub-group (22A, 22B, 22C) formed by four adjacent radiators coupled to two adjacent over-moded waveguide couplers. The shape of each of the over-moded waveguide coupler, in particular the configuration of over-moded section 40 for each over-moded waveguide coupler is selected or tailored so an energy distribution to the sub-group from the two adjacent over-moded waveguide couplers exhibits an amplitude taper characterized by an inner amplitude of energy to inner radiators of the sub-array that is greater than an outer amplitude of energy to outer radiators of the sub-array. For example, the energy to radiating elements 12D and 12E from the middle sub-array is greater than the energy to radiating elements 12C and 12F from the middle sub-array, and this distribution is characterized as an amplitude-taper. Furthermore, energy from the two adjacent over-moded waveguide couplers of the middle sub-array that propagates to the four adjacent radiators (radiating elements 12C, 12D, 12E, and 12F) that form the sub-group associated with the middle sub-array is characterized as in-phase, and energy from the two adjacent over-moded waveguide couplers that propagates to a secondary radiator (e.g. radiating elements 12B and 12G) adjacent the sub-group is characterized as out-of-phase with energy of the sub-group.

Continuing to refer to FIGS. 1 and 2, the feed network 16 includes an end coupler 60, 62 on each end of the feed network 16. The end coupler 60 includes a bulge 64 configured to compensate for a missing outer in-port, i.e.—the end coupler does not have two in-ports. The bulge 64 is generally configured to provide an alternative energy path 66 effective to cause energy that propagates to radiating elements 12G, 12H directly coupled to the end coupler 60 to be in-phase with energy that propagates to radiating elements 12E, 12F that are directly coupled to an adjacent over-moded waveguide coupler 68. The bulge 64 provides for the right sub-array that formed by the input 18C and the subgroup 22C to have performance characteristics comparable to those of the middle sub-array formed by the input 18B and the sub-group 22B.

Figure 4:
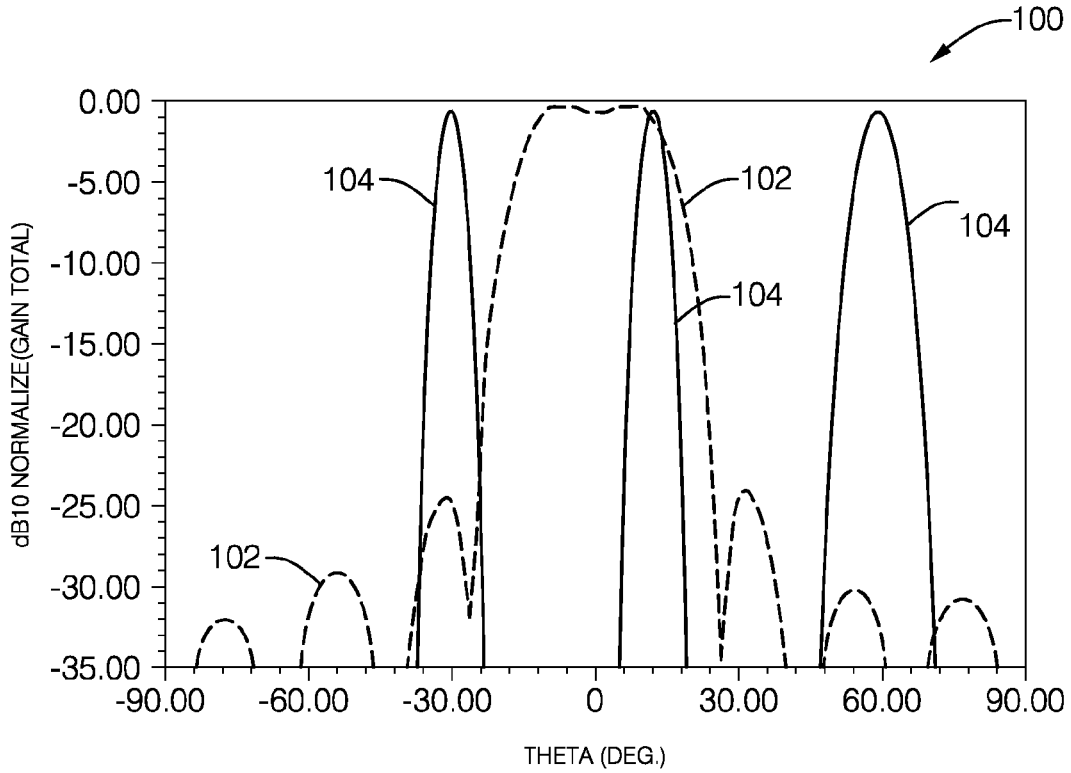
FIG. 4 is a graph of performance data for an antenna based on the antenna of FIG. 1A in accordance with one embodiment.
Figure 5:
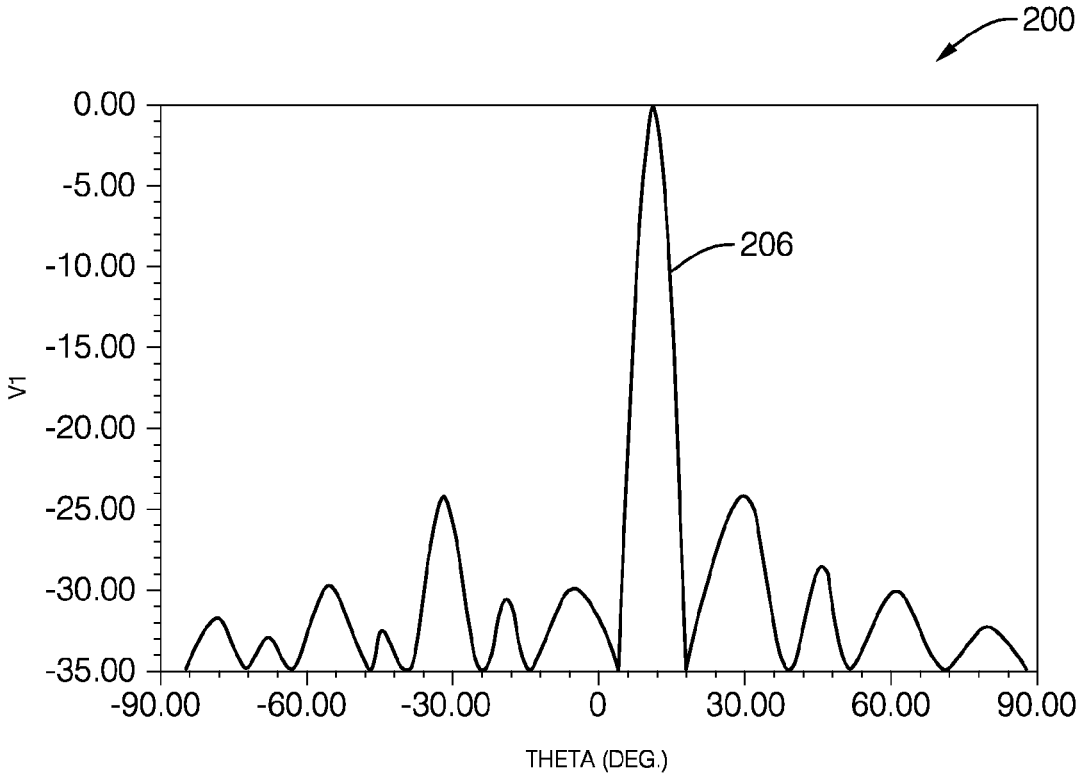
FIG. 5 is a graph of performance data for an antenna based on the antenna of FIG. 1A in accordance with one embodiment.

FIGS. 4 and 5 show graphs 100 and 200, respectively, of performance data for an antenna with twelve sub-arrays based on the antenna 10 with three sub-arrays described herein. Data 102 illustrates a gain pattern of a sub-array comparable to the middle sub-array of the antenna 10 formed by coupling the input 18B to radiating elements 12C, 12D, 12E, 12F, plus contributions from radiating elements 12B and 12G that help to provide the flat top gain characteristic. Those in the art will recognize that this sub-array advantageously exhibits relatively low side-lobes, and a narrow main beam width with a flat top. Data 104 illustrates an array factor pattern of the twelve sub-arrays that exhibits three lobes when scanned at 10 degrees. The middle lobe corresponds to the main beam. The left lobe and right lobe are commonly called grating lobes. Data 206 (FIG. 5) illustrates the total gain pattern of the antenna with twelve sub-arrays. The total gain pattern corresponds to the product (i.e.—multiplication) of these data 102 and data 104. Those in the art will recognize that the total gain pattern advantageously exhibits a high gain main beam and low side-lobes, and this characteristic is maintained for antenna scan between +/−10 degrees angle. It is noted that the antenna 10 described herein exhibits a main beam with 1.1 decibel (dB) higher gain, and 8 dB more suppression on the grating lobes than the 25% overlap antenna described in U.S. Pat. No. 7,868,828 entitled PARTIALLY OVERLAPPED SUB-ARRAY ANTENNA, issued Jan. 11, 2011 to Shi et al.

Accordingly, an antenna 10 suitable for use as a phased array antenna of a radar system that has 50% overlap is provided. The antenna 10 includes a low cost, preferably single layer feed network configured for 50% sub-array overlap. The feed network 16 controls energy to each sub-group of radiating elements so the sub-arrays exhibit desired amplitude and phase distributions, and thereby achieve the adequate isolation between the sub-arrays. The feed network for each sub-array is generally formed by two four-port couplers coupled to four radiating elements, two of which are shared with a sub-array to the left and two of which are shared with a sub-array to the right, except for the end sub-arrays. This sharing of half of the radiating elements neighboring sub-arrays defines the 50% overlap. For any one of the overlapped sub-arrays, there are three desired performance characteristics: (1) beam width equal to the scan angle in order to achieve the highest gain and grating lobe suppression, (2) flat gain within the scan angle to minimize scan loss and (3) low side-lobes for maximum grating lobe suppression. Also, every sub-array preferably exhibits an aperture distribution with uniform phase and tapered magnitude. A small leakage radiation with opposite phase from neighboring sub-arrays is advantageous to flatten the gain. The sub-arrays each include an over-moded section with a width allowing both TE10 and TE20 modes to propagate. The ratio of TE10 to TE20 in the over-moded section together with the section length determine the ratio of power transmitted to the out-ports. The non-limiting example presented herein has sub-arrays where the four radiating elements are characterized as having an 11.63 mm aperture size and a subarray-to-subarray separation of 5.815 mm. Every sub-array produces nearly the same narrow pattern. The flattened gain allows very small gain variation for scan angles of +/−10 degrees. Grating lobes are beyond 29 degrees from bore-sight for +/−10 degree scan and suppressed 22 dB by side-lobes.

While this invention has been described in terms of the preferred embodiments thereof, it is not intended to be so limited, but rather only to the extent set forth in the claims that follow.

I claim:

1. An antenna suitable for use as a phased array antenna of a radar system, said antenna comprising:

a plurality of radiating elements; and a feed network configured to define a plurality of inputs and couple energy from the inputs to the radiating elements, wherein energy from each of the inputs is coupled to a power divider, wherein the feed network is further configured to define a plurality of over-moded waveguide couplers configured to define a plurality of sub-arrays that couple each input to a sub-group of the radiating elements, wherein the sub-arrays are arranged in a side-by-side arrangement and configured such that half of the radiators of a sub-group are shared with an adjacent sub-group of an adjacent sub-array, wherein each of the over-moded waveguide couplers is configured to define a left in-port that receives energy from a left divider, a right in-port that receives energy from a right divider adjacent the left divider, a left out-port that guides energy to a left radiator, and a right out-port that guides energy to a right radiator adjacent the left radiator, wherein each over-moded waveguide coupler includes an over-moded section defined by a width selected such that energy propagates through the over-moded section in multiple modes effective to establish a first path for energy from the left in-port and a second path for energy from the right in-port, wherein the first path is distinct from the second path.

2. The antenna in accordance with claim 1, wherein the feed-network is formed about a single layer of substrate material.

3. The antenna in accordance with claim 1, wherein energy coupled from the over-moded section to left out-port is in-phase with energy coupled from the over-moded section to right out-port.

4. The antenna in accordance with claim 1, wherein the multiple modes include a TE10 mode and a TE20 mode.

5. The antenna in accordance with claim 1, wherein each over-moded section has a width and length selected such that a first amount of energy propagates from the left in-port to the left out-port, and a second amount of energy less than the first amount propagates from the left in-port to the right out-port.

6. The antenna in accordance with claim 5, wherein a third amount of energy less than the second amount propagates from the left in-port to the right in-port.

7. The antenna in accordance with claim 6, wherein energy that propagates from the left in-port to an adjacent radiator via the right in-port and is out-of-phase with energy from the left in-port that propagates to the left radiator and the right radiator.

8. The antenna in accordance with claim 1, wherein the over-moded waveguide coupler is characterized by a first distribution of energy from the left in-port that is a mirror image of a second distribution of energy from the right in-port.

9. The antenna in accordance with claim 1, wherein each sub-array includes a sub-group formed by four adjacent radiators coupled to two adjacent over-moded waveguide couplers, wherein an energy distribution to the sub-group from the two adjacent over-moded waveguide couplers exhibits an amplitude taper characterized by an inner amplitude of energy to inner radiators of the sub-array that is greater than an outer amplitude of energy to outer radiators of the sub-array.

10. The antenna in accordance with claim 9, wherein energy from the two adjacent over-moded waveguide couplers of the sub-array that propagates to the four adjacent radiators that form the sub-group is characterized as in-phase, and energy from the two adjacent over-moded waveguide couplers that propagates to a secondary radiator adjacent the sub-group is characterized as out-of-phase with energy of the sub-group.

11. The antenna in accordance with claim 1, wherein the feed network includes an end coupler on each end of the feed network, wherein the end coupler includes a bulge configured to compensate for a missing outer in-port, said bulge configured to provide an alternative energy path effective to cause energy that propagates to radiating elements directly coupled to the end coupler to be in-phase with energy that propagates to radiating elements directly coupled to an adjacent over-moded waveguide coupler.

* * * * *